US011471734B2

(12) United States Patent
Beach et al.

(10) Patent No.: US 11,471,734 B2
(45) Date of Patent: Oct. 18, 2022

(54) GOLF CLUB HEAD WITH REPOSITIONABLE WEIGHT

(71) Applicant: Taylor Made Golf Company, Inc., Carlsbad, CA (US)

(72) Inventors: Todd P. Beach, Encinitas, CA (US); Joseph Henry Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/138,543

(22) Filed: Dec. 30, 2020

(65) Prior Publication Data

US 2021/0178234 A1 Jun. 17, 2021

Related U.S. Application Data

(63) Continuation of application No. 16/583,047, filed on Sep. 25, 2019, now Pat. No. 10,881,927, which is a continuation of application No. 16/158,160, filed on Oct. 11, 2018, now Pat. No. 10,463,934, which is a continuation of application No. 14/508,981, filed on Oct. 7, 2014, now Pat. No. 10,112,085, which is a continuation of application No. 14/047,880, filed on Oct. 7, 2013, now Pat. No. 8,870,678, which is a continuation of application No. 13/898,313, filed on May 20, 2013, now Pat. No. 8,734,271, which is a (Continued)

(51) Int. Cl.

| | |
|---|---|
| ***A63B 53/06*** | (2015.01) |
| ***A63B 53/04*** | (2015.01) |
| ***A63B 60/00*** | (2015.01) |

(52) U.S. Cl.

CPC ..... *A63B 53/06* (2013.01); *A63B 53/0466* (2013.01); *A63B 60/00* (2015.10); *A63B 53/047* (2013.01); *A63B 53/0487* (2013.01); *A63B 2053/0491* (2013.01); *Y10T 29/4984* (2015.01)

(58) Field of Classification Search

CPC ..... A63B 2053/0491; A63B 53/0408
USPC ..... 473/324–350
See application file for complete search history.

(56) References Cited

U.S. PATENT DOCUMENTS

| | | | |
|---|---|---|---|
| 2,158,830 | A | 5/1939 | Newsom |
| 3,979,123 | A | 9/1976 | Belmont |

(Continued)

FOREIGN PATENT DOCUMENTS

| | | | |
|---|---|---|---|
| EP | 0470488 | B1 | 3/1995 |
| EP | 0617987 | B1 | 11/1997 |

(Continued)

OTHER PUBLICATIONS

Final Office action from the U.S. Patent and Trademark Office in U.S. Appl. No. 11/613,138, dated Oct. 16, 2008.

(Continued)

*Primary Examiner* — Alvin A Hunter
(74) *Attorney, Agent, or Firm* — Klarquist Sparkman, LLP

(57) ABSTRACT

A golf club head comprises a body, a track formed in or attached to the body and having a length and a weight and weight retainer. The weight is continuously repositionable such that it can be positioned at any selected point along the track between its ends. The weight has a major dimension, and the weight retainer comprises a fastening member having a diameter not greater than about one half of the major dimension of the weight.

20 Claims, 2 Drawing Sheets

FIG. 3

Related U.S. Application Data continuation of application No. 12/847,187, filed on Jul. 30, 2010, now Pat. No. 8,444,505, which is a continuation of application No. 11/613,138, filed on Dec. 19, 2006, now Pat. No. 7,775,905.

(56) References Cited

U.S. PATENT DOCUMENTS 4,795,159 A 1/1989 Nagamoto
4,803,023 A 2/1989 Enomoto et al.
5,028,049 A * 7/1991 McKeighen ..... A63B 60/00 473/345
5,121,922 A 6/1992 Harsh, Sr.
5,251,901 A 10/1993 Solheim et al.
5,297,794 A 3/1994 Lu
5,395,113 A 3/1995 Antonious
5,564,705 A 10/1996 Kobayashi et al.
5,613,917 A 3/1997 Kobayashi et al.
5,658,206 A 8/1997 Antonious
5,683,309 A 11/1997 Reimers
5,688,189 A * 11/1997 Bland ..... A63B 60/02 473/314
5,720,674 A 2/1998 Galy
5,766,095 A 6/1998 Antonious
5,769,737 A 6/1998 Holladay et al.
5,776,010 A 7/1998 Helmstetter et al.
5,788,587 A 8/1998 Tseng
5,851,160 A 12/1998 Rugge et al.
5,911,638 A 6/1999 Parente et al.
5,913,735 A 6/1999 Kenmi
5,916,042 A 6/1999 Reimers
5,935,019 A 8/1999 Yamamoto
5,967,905 A 10/1999 Nakahara et al.
5,971,867 A 10/1999 Galy
5,976,033 A 11/1999 Takeda
6,015,354 A * 1/2000 Ahn ..... A63B 53/0466 473/256
6,033,318 A 3/2000 Drajan, Jr. et al.
6,033,321 A 3/2000 Yamamoto
6,056,649 A 5/2000 Imai
6,062,988 A 5/2000 Yamamoto
6,077,171 A 6/2000 Yoneyama
6,089,994 A 7/2000 Sun
6,123,627 A 9/2000 Antonious
6,162,132 A 12/2000 Yoneyama
6,171,204 B1 1/2001 Starry
6,190,267 B1 2/2001 Marlowe et al.
6,203,448 B1 3/2001 Yamamoto
6,206,789 B1 3/2001 Takeda
6,206,790 B1 3/2001 Kubica et al.
6,210,290 B1 4/2001 Erickson et al.
6,217,461 B1 4/2001 Galy
6,277,032 B1 8/2001 Smith
6,290,609 B1 9/2001 Takeda
6,306,048 B1 10/2001 McCabe et al.
6,348,012 B1 2/2002 Erickson et al.
6,364,788 B1 4/2002 Helmstetter et al.
6,368,234 B1 * 4/2002 Galloway ..... B21J 5/00 473/349
6,379,264 B1 4/2002 Forzano
6,379,265 B1 4/2002 Hirakawa et al.
6,381,828 B1 * 5/2002 Boyce ..... A63B 53/04 29/527.4
6,386,987 B1 5/2002 Lejeune, Jr.
6,398,666 B1 * 6/2002 Evans ..... A63B 60/00 473/345
6,409,612 B1 6/2002 Evans et al.
6,428,426 B1 * 8/2002 Helmstetter ..... A63B 60/00 473/331
6,434,811 B1 8/2002 Helmstetter et al.
6,440,009 B1 8/2002 Guibaud et al.
6,440,010 B1 8/2002 Deshmukh
6,440,011 B1 * 8/2002 Hocknell ..... C23F 1/00 473/342
6,443,851 B1 9/2002 Liberatore
6,458,044 B1 10/2002 Vincent et al.
6,461,249 B2 10/2002 Liberatore
6,475,101 B2 11/2002 Burrows
6,475,102 B2 11/2002 Helmstetter et al.
6,508,722 B1 * 1/2003 McCabe ..... A63B 53/04 473/330
6,508,978 B1 1/2003 Deshmukh
6,524,198 B2 2/2003 Takeda
6,530,848 B2 3/2003 Gillig
6,533,679 B1 3/2003 McCabe et al.
6,569,029 B1 5/2003 Hamburger
6,592,468 B2 7/2003 Vincent et al.
6,616,547 B2 9/2003 Vincent et al.
6,638,183 B2 10/2003 Takeda
6,641,490 B2 11/2003 Ellemor
6,648,772 B2 11/2003 Vincent et al.
6,652,387 B2 11/2003 Liberatore
6,716,111 B2 4/2004 Liberatore
6,719,641 B2 4/2004 Dabbs et al.
6,739,983 B2 5/2004 Helmstetter et al.
6,749,523 B1 6/2004 Forzano
6,773,360 B2 8/2004 Willett et al.
6,773,361 B1 8/2004 Lee
6,805,643 B1 10/2004 Lin
6,808,460 B2 10/2004 Namiki
6,860,818 B2 3/2005 Mahaffey et al.
6,875,124 B2 4/2005 Gilbert et al.
6,881,158 B2 4/2005 Yang et al.
6,890,267 B2 5/2005 Mahaffey et al.
6,923,734 B2 8/2005 Meyer
6,926,619 B2 8/2005 Helmstetter et al.
7,147,573 B2 * 12/2006 DiMarco ..... A63B 53/0466 473/324
7,166,041 B2 * 1/2007 Evans ..... A63B 60/02 473/334
7,201,669 B2 4/2007 Stites et al.
7,452,286 B2 * 11/2008 Lin ..... A63B 60/02 473/334
7,520,820 B2 * 4/2009 Dimarco ..... A63B 53/0466 473/334
7,611,424 B2 * 11/2009 Nagai ..... A63B 53/0466 473/334
7,628,711 B2 * 12/2009 Akinori ..... A63B 60/02 473/335
7,704,163 B2 * 4/2010 Stites ..... A63B 60/02 473/334
7,775,905 B2 * 8/2010 Beach ..... A63B 53/0466 473/334
7,824,280 B2 * 11/2010 Yokota ..... A63B 60/00 473/334
7,854,667 B2 12/2010 Gillig
8,016,694 B2 * 9/2011 Llewellyn ..... A63B 53/04 473/334
8,192,303 B2 * 6/2012 Ban ..... A63B 53/04 473/335
8,202,175 B2 * 6/2012 Ban ..... A63B 53/04 473/338
8,206,243 B2 * 6/2012 Stites ..... A63B 53/0466 473/334
8,444,505 B2 * 5/2013 Beach ..... A63B 60/00 473/334
8,696,491 B1 * 4/2014 Myers ..... A63B 60/02 473/334
8,734,271 B2 * 5/2014 Beach ..... A63B 53/06 473/334
8,870,678 B2 * 10/2014 Beach ..... A63B 53/0466 473/334
9,259,627 B1 * 2/2016 Myers ..... A63B 53/04
9,597,563 B2 * 3/2017 Voshall ..... A63B 53/0466
9,636,553 B1 * 5/2017 Myers ..... A63B 60/02
9,731,175 B1 * 8/2017 Myers ..... A63B 60/52
10,463,934 B2 * 11/2019 Beach ..... A63B 53/06
2005/0137024 A1 6/2005 Stites et al.
2006/0122004 A1 * 6/2006 Chen ..... A63B 53/0466 473/335
2006/0172821 A1 * 8/2006 Evans ..... A63B 53/0466 473/349

(56) References Cited

U.S. PATENT DOCUMENTS

| | | | | |
|---|---|---|---|---|
| 2006/0178228 | A1* | 8/2006 | DiMarco | A63B 53/0466 473/334 |
| 2006/0240908 | A1* | 10/2006 | Adams | A63B 53/047 473/334 |
| 2008/0020861 | A1* | 1/2008 | Adams | A63B 53/04 473/334 |
| 2008/0146370 | A1* | 6/2008 | Beach | A63B 60/00 473/336 |
| 2008/0176672 | A1* | 7/2008 | Roach | A63B 53/0487 473/340 |
| 2008/0261715 | A1* | 10/2008 | Carter | A63B 60/00 473/291 |
| 2010/0075773 | A1* | 3/2010 | Casati, Jr. | A63C 5/075 473/334 |
| 2012/0034992 | A1* | 2/2012 | Boyd | A63B 53/0466 473/290 |
| 2013/0344976 | A1* | 12/2013 | Stites | A63B 53/047 473/291 |

FOREIGN PATENT DOCUMENTS

| | | | | | |
|---|---|---|---|---|---|
| JP | 06238022 | A | | 8/1994 | |
| JP | 2005296582 | A | * | 10/2005 | |
| JP | 2005296582 | A | | 10/2005 | |
| JP | 2005323978 | A | * | 11/2005 | |
| JP | 2005323978 | A | | 11/2005 | |
| JP | 2006320493 | A | * | 11/2006 | |
| JP | 2006320493 | A | | 11/2006 | |
| JP | 2011229914 | A | * | 11/2011 | |
| JP | 2011229914 | A | | 11/2011 | |
| JP | 2012125291 | | | 7/2012 | |
| JP | 2012125291 | A | * | 7/2012 | |
| WO | WO-8802642 | A1 | * | 4/1988 | A63B 53/0487 |
| WO | WO2007/044220 | | | 4/2007 | |
| WO | WO-2007044220 | A1 | * | 4/2007 | A63B 53/047 |

OTHER PUBLICATIONS

Final Office action from the U.S. Patent and Trademark Office in U.S. Appl. No. 11/613,138, dated Jul. 28, 2009.

Final Office action from the U.S. Patent and Trademark Office in U.S. Appl. No. 12/847,187, dated May 23, 2011.

Final Office action from the U.S. Patent and Trademark Office in U.S. Appl. No. 12/847,187, dated Mar. 22, 2012.

Office action from the U.S. Patent and Trademark Office in U.S. Appl. No. 11/613,138, dated Mar. 21, 2008.

Office action from the U.S. Patent and Trademark Office in U.S. Appl. No. 11/613,138, dated Feb. 13, 2009.

Office action from the U.S. Patent and Trademark Office in U.S. Appl. No. 11/613,138, dated Nov. 5, 2009.

Office action from the U.S. Patent and Trademark Office in U.S. Appl. No. 12/847,187, dated Nov. 15, 2010.

Office action from the U.S. Patent and Trademark Office in U.S. Appl. No. 12/847,187, dated Sep. 20, 2011.

Office action from the U.S. Patent and Trademark Office in U.S. Appl. No. 12/847,187, dated Aug. 17, 2012.

Office action from the U.S. Patent and Trademark Office in U.S. Appl. No. 14/047,880, dated Dec. 6, 2013.

* cited by examiner

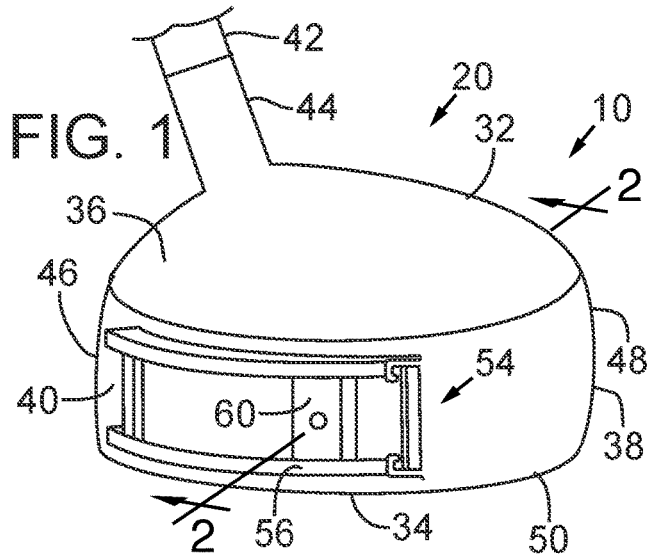
FIG. 1
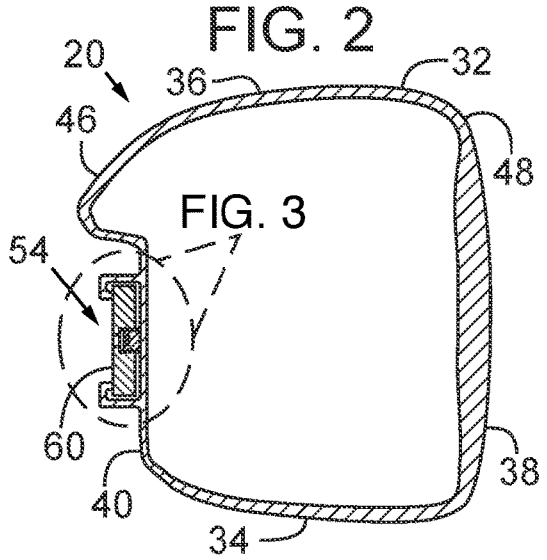
FIG. 2
FIG. 3
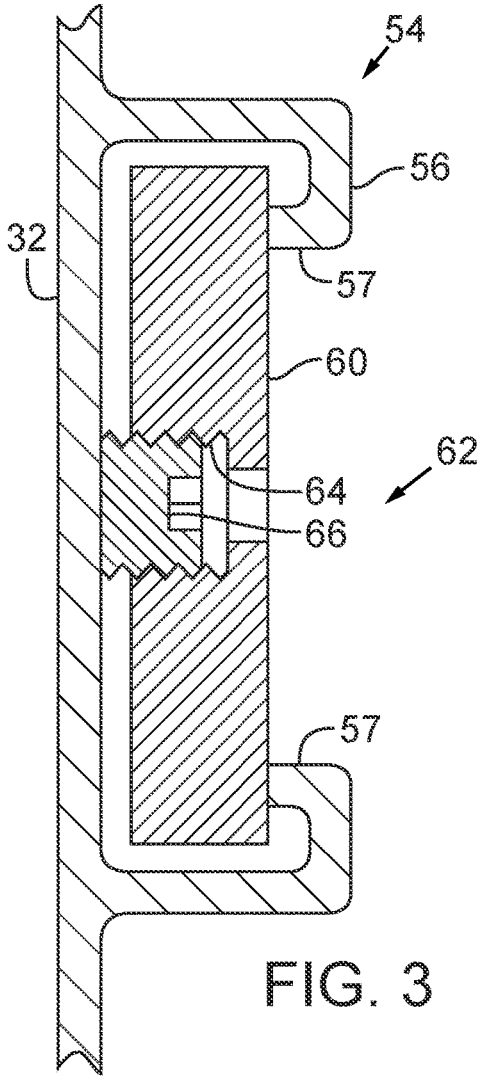
FIG. 3
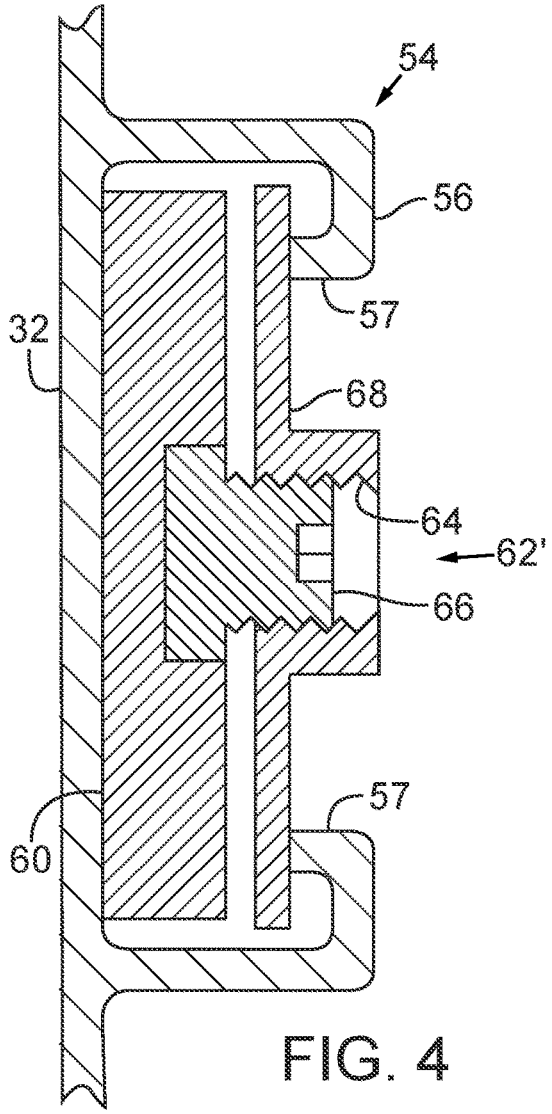
FIG. 4

GOLF CLUB HEAD WITH REPOSITIONABLE WEIGHT

CROSS REFERENCE TO RELATED APPLICATIONS

This application is a continuation of U.S. patent application Ser. No. 16/583,047, filed on Sep. 25, 2019, which is a continuation of U.S. patent application Ser. No. 16/158,160, filed on Oct. 11, 2018, now U.S. Pat. No. 10,463,934, which is a continuation of U.S. patent application Ser. No. 14/508,981, filed Oct. 7, 2014, now U.S. Pat. No. 10,112,085, which is a continuation of Ser. No. 14/047,880, filed Oct. 7, 2013, now U.S. Pat. No. 8,870,678, which is a continuation of Ser. No. 13/898,313, filed May 20, 2013, now U.S. Pat. No. 8,734,271, which is a continuation of U.S. patent application Ser. No. 12/847,187, filed Jul. 30, 2010, now U.S. Pat. No. 8,444,505, which is a continuation of U.S. patent application Ser. No. 11/613,138, filed Dec. 19, 2006, now U.S. Pat. No. 7,775,905, each of which is hereby incorporated by reference.

FIELD

The present application is directed to a golf club head, particularly a golf club head having at least one repositionable weight.

BACKGROUND

The center of gravity (CG) of a golf club head is a critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable material, such as steel or titanium alloys. These materials are typically used to form thin club head walls. Thinner walls are lighter, and thus result in greater discretionary weight, i.e., the portion of the overall weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be added to the interior of the club head through the club head's hosel opening to obtain a final desired weight of the club head. To achieve significant localized mass, weights formed of high-density materials have been attached to the sole, skirt, and other parts of a club head. With these weights, the method of installation is critical because the club head endures significant loads at impact with a golf ball, which can dislodge a weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

One approach to providing "movable weight" is seen in the TaylorMade r7 golf club product lines. In these golf clubs, weights having adjustable masses can be fitted to a fixed number of predetermined locations on the golf club head. This approach allows many fitting situations to be addressed, but there are still some circumstances in which golfers would appreciate greater flexibility.

SUMMARY

Disclosed below are representative embodiments that are not intended to be limiting in any way. Instead, the present disclosure is directed toward novel and nonobvious features, aspects, and equivalents of the embodiments of the golf club head having one or more movable weights.

According to some embodiments, the golf club head has at least one continuously repositionable weight, which is defined herein to mean a weight that can be positioned at any point within a defined area and is not limited to a finite number of predetermined positions. In other embodiments, the weight or weights are movable between multiple predetermined positions.

According to a representative embodiment, a golf club head comprises a body, a track formed in or attached to the body and having a length and at least one weight and a weight retainer. The weight is continuously repositionable such that it can be positioned at any selected point along the track between its ends. The weight has a major dimension and the weight retainer comprises a fastening member having a diameter not greater than about one half the major dimension of the weight.

The track can positioned generally in the aft portion of the club head. The track can be positioned generally within the ribbon of the club head.

The track can be a channel having two spaced apart channel walls and a bottom formed by an outer surface of the body. The channel walls can have an inverted "J" cross section defining hooked ends. The channel walls can be formed as a single piece with the body.

The weight can be dimensioned to be received and slidably movable within the track. Alternatively, the weight can be dimensioned to fit over the track.

The weight can comprise a pair of opposing legs and a channel-shaped track opening defined between the legs, with the track opening dimensioned to receive the track when the weight is positioned over the track with the leg portions straddling opposite sides of the track and bearing against the body at points outside of the track.

The weight can comprise a bore configured to threadedly receive the fastening member. The weight can be generally plate-shaped.

The track can be a channel, and the fastening member can be configured to extend through the bore in the weight and to tighten against an inner side of the channel, thereby pressing the weight outwardly against an outer side of the channel.

The weight retainer can comprise a retainer plate with a threaded bore dimensioned to receive the fastening member, and wherein the weight is positioned against an inner side of the channel, the retainer plate is positioned within and against the outer side of the channel and the fastening member is tightened to press the retainer plate outward against the channel and to press the weight inwardly against the inner side of the channel.

The fastening member can comprise a head end and an opposite end dimensioned larger than the channel opening, and wherein, with the opposite end of the threaded member received in the channel and threadedly received in the bore of the weight, the head end can be tightened to urge the weight toward the body and to urge the retainer plate toward an outer side of the channel. The weight retainer can also comprise a washer positioned between the opposite end of the fastening member and the channel, wherein the washer facilitates rotation of the opposite end relative to the channel when the fastening member is rotated.

The head can comprise a rib formed on the exterior of the body and having a generally T-shaped cross-section and a coupling member for coupling the rib to the opposite end of the fastening member. The coupling member can comprise a C-shaped coupler.

The fastening member can have a head end and an opposite end dimensioned to slide within the channel but larger than a channel opening of the channel.

The golf club head can comprise a body, a track formed in or attached to the body and having a length and a weight and coaxial weight retainer. The weight and the weight retainer are configured to exert at least two retaining forces at a selected position along the track in generally opposing directions, with one of the two forces being exerted in a direction toward the head and the other of the two forces being exerted in a direction away from the head.

The track can comprise a channel, and wherein the weight exerts a retaining force in a direction away from the head on an outer side of the channel and the weight retainer exerts a retaining force on the weight in a direction toward the head.

The weight retainer can comprise a fastening member and a retainer plate with a bore dimensioned to threadedly receive the fastening member, wherein the track comprises a channel, and wherein when the fastening member is tightened, the fastening plate exerts a retaining force in a direction away from the head on an outer side of the channel and the fastening member exerts a retaining force on the weight in a direction toward the head.

The disclosed features and aspects of the embodiments can be used alone or in various novel and nonobvious combinations and sub-combinations with one another.

BRIEF DESCRIPTION OF THE DRAWINGS

FIG. 1 is a schematic perspective view of a representative golf club head with a track and a continuously repositionable weight positionable at any desired point along the track.

FIG. 2 is a cross sectional view of the golf club head of FIG. 1 taken along the line 2-2 and showing a section of the head and the track in elevation.

FIG. 3 is a section view of a track and a weight secured in the track, according to one embodiment.

FIG. 4 is a section view of a track and a weight secured in the track, according to another embodiment.

DETAILED DESCRIPTION

Figure 5:
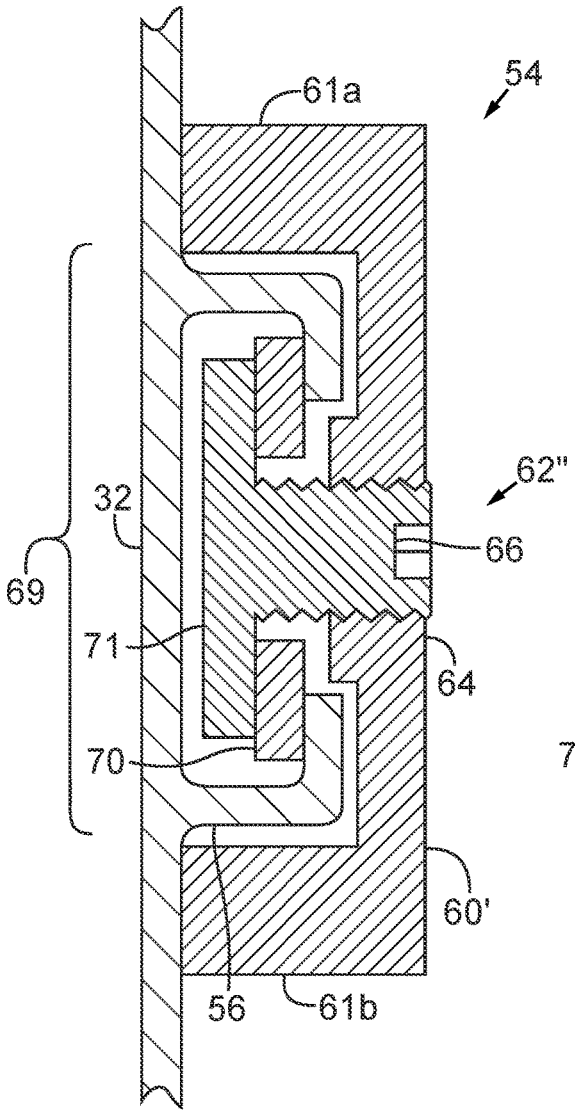
FIG. 5 is a section view of a track and a weight secured in the track, according to another embodiment.

A representative golf club 10 is shown in FIG. 1. The golf club 10 has a golf club head 20, which is attached to a shaft 42 (shown partially in FIG. 1), such as by a hosel 44. The golf club head 20 has a body 32 with a sole 34, a crown 36, a face 38 for striking the ball that extends between the crown 36 and the sole 34 at a fore end 48, and a ribbon 40 that comprises a portion of the body 32 between the crown 36 and the sole 34 at an aft end 46.

Referring to FIG. 1, the face 38 of the golf club head 20 is oriented toward the right, thus making a toe end 50 of the body 32 visible in the figure. A heel end of the body, although not shown in the figures, is generally opposite the toe end 50, and closer to the hosel 44.

The body 32 comprises a track 54, which can be described as being generally located in the ribbon 40 and closer to the aft end 46 than the fore end 48. Thus, if the aft end 46 and/or the ribbon 40 is curved, such as is shown for the representative head 20 of FIG. 1, the track 54 can extend along a curved path to follow its general shape.

FIG. 2 is a section view in elevation taken at the position shown in FIG. 1 and viewed in the direction of the arrows. As shown in FIGS. 1 and 2, the track 54 is configured to allow at least one weight 60 to be secured in place at a selected location along the track 54 to allow the club's characteristics to be changed as desired. The weight 60 is releasably secured, so that it remains in the selected location even after the golf club is subjected to use, but it can be removed or replaced when desired, such as to replace the weight, to remove the weight or to change the weight's position. In the illustrated embodiments, the weight is continuously repositionable, i.e., the track 54 allows the position of the weight 60 to be infinitely adjustable (secured at any selected position) along the length of the track between its ends and is not limited to being positioned in one of a finite number of predefined positions.

As shown in FIGS. 1 and 2, the track 54 in some embodiments protrudes from the surrounding surface of the body 32. In other embodiments, the track may be formed flush with the surrounding surface, or it may be recessed. In the illustrated embodiments, the track 54 is configured to retain the weight 60 within the track even if the weight is not yet secured in a selected position or has become unsecured. In this way, the chances of loss of the weight 60 (and other components), possible injury to others, and/or damage to property are reduced.

FIG. 3 is an enlarged view of a portion of FIG. 2 showing details of one implementation of the track 54 and weight 60. As shown in FIG. 3, the track 54 may comprise a channel 56 attached to or formed in the body 32 of the head 20. The channel 56 is comprised of a pair of spaced apart channel members 57 that protrude from the outer surface of the body 32 that can have hooked ends as shown. In other words, the channel members 57 can be described as having an inverted "J" profile. The channel 56 and the weight 60 are relatively dimensioned with respect to each other to allow the weight 60 to be moved to different points along the channel, such as by sliding the weight 60.

In the embodiment of FIG. 3, a weight retainer 62 retains the weight 60 in a selected position along the channel 56. The retainer 62 can be released to allow the weight 60 to be moved to a different position or removed from the channel (e.g., such as through an opened end of the channel). In the illustrated embodiments, the weight retainer 62 comprises a fastener, such as a threaded fastener or threaded section of a member, although other approaches are also possible.

For example, as shown in FIG. 3, the weight retainer 62 can comprise a fastener (such as, e.g., a set screw) or fastening member 66 that threadedly engages a bore 64 formed in the weight 60 to allow the weight 60 to be secured against an outer side of the channel (toward the aft direction) when the fastening member 66 is tightened against the inner side of the channel 56 (which may be the outer surface of the body). The fastening member 66 can have any suitable type of head (such as, e.g., a hex head or a TORX head) to allow use a tool for tightening or loosening the retainer 62.

The approach in FIG. 3 is suitable for many applications. A relatively large weight 60 may be suitably secured with the fastening member 66. For example, in some embodiments, the diameter of the fastening member 66 is not greater than one half of the major dimension of the weight 60. For additional security in some applications, the approach in FIG. 4, which allows the relatively heavy weight to be secured against a larger surface than in FIG. 3, can be followed.

Referring to FIG. 4, the weight 60 is secured by contact of its major surface with the base of the channel 56, rather than by contact between only the ends of the weight 60 and the channel 56 as shown in FIG. 3. Because of the greater surface area of the contact region, the weight 60 can be retained more securely. The head 20 experiences dramatic forces of about 10,000 G during impact with a golf ball. The effect of these forces in tending to loosen the weight retainer 62' is lessened because the weight is pressed against the head rather than being spaced apart from the head. This direct load transfer from the weight to the head is more efficient than having the load transferred through a smaller member, such as the weight retainer 62 shown in FIG. 3.

In FIG. 4, the weight retainer 62' comprises the fastener 66, configured to have its end free to turn and to bear against the weight 60, and a retainer plate 68 with the threaded bore 64 engaged with the fastener 66. When the fastener 66 is tightened, the weight 60 is pressed inwardly against the body 32, and the retainer plate 68, which is larger than the channel opening and not free to rotate, is pressed against the outer side of the channel 56. Because the weight 60 and retainer plate 68 are larger than the channel opening, these components will not separate from the head 20 if the weight 60 becomes unsecured.

Another alternative approach is shown in FIG. 5. In FIG. 5, a weight 60' is configured with a channel receiving opening 69 dimensioned to fit over the channel 56 as shown. The weight 60' has legs 61*a*, 61*b* shaped to straddle the channel 56 and to bear against the outer surface of the body 32 in areas outside of the channel 56, and is secured by the fastening member 66 threadedly engaged in the bore 64 in the weight. In the weight retainer 62", the fastening member 66 has an exposed or head end that can be driven by a tool and an opposite enlarged end 71 dimensioned larger than the channel opening. As the fastening member 66 is tightened, it tends to pull the weight 60' inwardly with the legs 61*a*, 61*b* bearing against the body 32 as shown. Optionally, a washer 70 can be placed between the exposed end of the fastening member 66 and the outer side of the channel 56 as shown to prevent wear and allow for easy tightening of the assembly.

Figure 6:
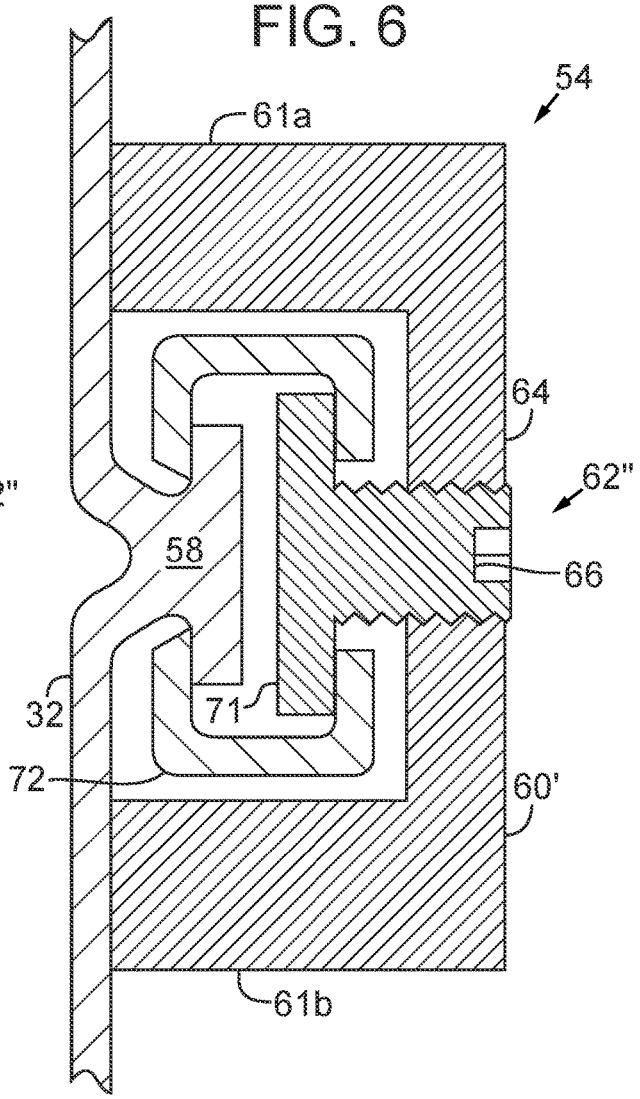
FIG. 6 is a section view of a track and a weight a track and a weight secured in the track, according to another embodiment.

FIG. 6 illustrates an approach similar to FIG. 5, except that the track 54 is formed as a rib or a rail 58 rather than the channel 56. In FIG. 6, there is a member 72, such as, e.g., a C-channel coupler as shown or another suitable construction, that couples the enlarged end of the fastener 66 (which is larger in size than the opening) to the rib 58. Similar to the FIG. 5 approach, when the fastener 66 is tightened, the weight 60' is pulled inwardly with the legs 61*a*, 61*b* bearing against the body 32.

Although described above in connection with a single weight, it is of course possible to use multiple weights that are individually secured in selected positions. In the illustrated embodiments, the concepts are shown for a driver, but it is possible to implement the same concepts for virtually any other type of club, including fairway woods, hybrid clubs, irons, putters, wedges, etc.

The weight or weights may be made from one or more materials, such as, e.g., steel, tungsten, titanium, copper, brass, aluminum, depleted uranium, magnesium, etc. The track and weight retainer can also be made of any suitable material, such as, e.g., titanium, aluminum, magnesium, composites or plastics. The track can be configured to allow complete removal of the weight, such as, e.g., at an end of the track.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

What is claimed is:

1. A golf club head, comprising:

a thin walled body including a crown portion, a sole portion, and a skirt portion extending between the crown and the sole portion, a face portion having a thickness that varies and extending between the sole portion and the crown portion at a fore end of the body opposite an aft end of the body, and a rearmost edge at the aft end of the body;

a curved channel in the body below the rearmost edge and located adjacent the aft end of the body and following a perimeter shape of the aft end of the body, the channel extending from a toe side of the body to a heel side of the body and at least partially located in the skirt portion of the body;

a weight portion located at least partially within the channel and adjustable to a plurality of points along the channel, the weight portion having a shape that prevents substantial rotation within the channel; and a threaded fastening member having an exposed end portion configured to be driven by a tool to place the fastening member in tension and affix the weight portion against a portion of the channel;

wherein the rearmost edge extends beyond the weight portion so that the weight portion is not visible in a top plan view looking vertically downward at the body;

wherein the weight portion is formed of a weight portion material, the fastening member is formed of a fastening member material, and the face portion is formed of a face portion material different than at least one of the fastening member material and the weight portion material;

wherein the channel having a first sidewall, a second sidewall spaced apart from the first sidewall by a channel width, and a base recessed a channel depth from an adjacent exterior surface of the body, wherein a portion of at least one sidewall is flush with the adjacent exterior surface of the body and the sidewall extends toward an interior of the club head to join the base.

2. The golf club head of claim 1, wherein the weight portion is repositionable to multiple predetermined positions.

3. The golf club head of claim 1, wherein the fastening member material is different than the weight portion material.

4. The golf club head of claim 1, wherein a portion of the body is formed of non-metallic material.

5. The golf club head of claim 1, wherein the channel has closed ends to prevent the weight portion from exiting the ends of the channel.

6. The golf club head of claim 5, wherein the weight portion is removable from the channel.

7. The golf club head of claim 6, wherein the weight portion includes a bore, and the fastening member includes a head and a threaded shaft portion that extends through the bore to engage the body.

8. The golf club head of claim 7, wherein the channel depth is less than the channel width.

9. The golf club head of claim 1, wherein a portion of the weight portion is in contact with the base when the weight portion is secured.

10. The golf club head of claim 1, further comprising:

wherein the crown portion is formed of a crown portion material different than at least one of the fastening member material and the weight portion material.

11. The golf club head of claim 10, wherein the fastening member material is different than the weight portion material.

12. The golf club head of claim 10, wherein the channel has closed ends to prevent the weight portion from exiting the ends of the channel.

13. The golf club head of claim 12, wherein the weight portion includes a bore, and the fastening member includes a head and a threaded shaft portion that extends through the bore to engage the body.

14. The golf club head of claim 12, wherein a portion of the body is formed of non-metallic material.

15. The golf club head of claim 10, wherein the channel depth is less than the channel width.

16. The golf club head of claim 10, wherein a portion of the weight portion is in contact with the base when the weight portion is secured.

17. The golf club head of claim 1, further comprising:

wherein the sole portion is formed of a sole portion material different than at least one of the fastening member material and the weight portion material.

18. The golf club head of claim 17, wherein the channel has closed ends to prevent the weight portion from exiting the ends of the channel.

19. The golf club head of claim 18, wherein the fastening member material is different than the weight portion material.

20. The golf club head of claim 18, wherein the weight portion includes a bore, and the fastening member includes a head and a threaded shaft portion that extends into the bore.

* * * * *